US011545277B2

(12) United States Patent
Takahashi et al.

(10) Patent No.: US 11,545,277 B2
(45) Date of Patent: Jan. 3, 2023

(54) COPPER ALLOY WIRE, CABLE, AND METHOD OF MANUFACTURING COPPER ALLOY WIRE

(71) Applicant: Hitachi Metals, Ltd., Tokyo (JP)

(72) Inventors: Kazuhisa Takahashi, Tokyo (JP); Shohei Hata, Tokyo (JP); Hiromitsu Kuroda, Tokyo (JP); Toru Sumi, Tokyo (JP); Kazuya Nishi, Tokyo (JP); Keisuke Fujito, Tokyo (JP); Takayuki Tuji, Tokyo (JP)

(73) Assignee: Hitachi Metals, Ltd., Tokyo (JP)

( * ) Notice: Subject to any disclaimer, the term of this patent is extended or adjusted under 35 U.S.C. 154(b) by 48 days.

(21) Appl. No.: 16/538,106

(22) Filed: Aug. 12, 2019

(65) Prior Publication Data

US 2020/0075193 A1 Mar. 5, 2020

(30) Foreign Application Priority Data

Aug. 30, 2018 (JP) ..... JP2018-160955
Jul. 16, 2019 (JP) ..... JP2019-130842

(51) Int. Cl.
*H01B 1/02* (2006.01)
*C22C 9/00* (2006.01)
(Continued)

(52) U.S. Cl.
CPC ..... *H01B 1/026* (2013.01); *C22C 9/00* (2013.01); *C22F 1/08* (2013.01); *H01B 13/0016* (2013.01)

(58) Field of Classification Search
None
See application file for complete search history.

(56) References Cited

U.S. PATENT DOCUMENTS 6,053,994 A * 4/2000 Saleh ..... C22C 9/00 148/432
2012/0018192 A1 1/2012 Takahashi et al.
(Continued)

FOREIGN PATENT DOCUMENTS

CN 101724759 A 6/2010
CN 102356435 A 2/2012
(Continued)

OTHER PUBLICATIONS

Chinese-language Office Action issued in Chinese Application No. 201910749640.5 dated Aug. 23, 2021 with English translation (13 pages).
(Continued)

*Primary Examiner* — Brian D Walck
(74) *Attorney, Agent, or Firm* — Crowell & Moring LLP

(57) ABSTRACT

Bendability of a copper alloy wire is improved without decrease in an electrical conductivity of the copper alloy wire made of copper alloy containing zirconium. A cable includes: a two-core stranded wire formed by intertwining two electrical wires made of a conductor and an insulating layer covering the conductor; a filler formed around the two-core stranded wire; and a sheath formed around the filler and the electrical wire. The conductor is a copper alloy wire in which a precipitate containing the zirconium disperses, and has a crystal gain diameter that is equal to or smaller than 1 μm, an electrical conductivity that is equal to or higher than 87% IACS, and a tensile stress that is equal to or larger than 545 MPa.

2 Claims, 4 Drawing Sheets

(51) Int. Cl.
*C22F 1/08* (2006.01)
*H01B 13/00* (2006.01)

(56) References Cited

U.S. PATENT DOCUMENTS

| | | | |
|---|---|---|---|
| 2016/0284437 | A1 | 9/2016 | Inoue et al. |
| 2018/0102199 | A1 | 4/2018 | Uegaki et al. |

FOREIGN PATENT DOCUMENTS

| | | | |
|---|---|---|---|
| CN | 105543540 | A | 5/2016 |
| CN | 105745340 | A | 7/2016 |
| CN | 107532238 | A | 1/2018 |
| JP | 63-243240 | A | 10/1988 |
| WO | WO 2010/084989 | A1 | 7/2010 |

OTHER PUBLICATIONS

Chinese-language Office Action issued in Chinese Application No. 201910749640.5 dated Mar. 29, 2022 with English translation (13 pages).

* cited by examiner

COPPER ALLOY WIRE, CABLE, AND METHOD OF MANUFACTURING COPPER ALLOY WIRE

CROSS-REFERENCE TO RELATED APPLICATION

The present application claims priority from Japanese Patent Applications No. 2018-160955 filed on Aug. 30, 2018, and No. 2019-130842 filed on Jul. 16, 2019, the contents of which are hereby incorporated by reference into this application.

TECHNICAL FIELD OF THE INVENTION

The present invention relates to a copper alloy wire, a cable, and a method of manufacturing the copper alloy wire.

BACKGROUND OF THE INVENTION

Conventionally, for a conductor configuring an electrical wire and a cable, a copper alloy wire made of copper alloy has been used in some cases. For example, Japanese Patent Application Laid-Open Publication No. S63-243240 (Patent Document 1) and International Patent Publication No. WO/2010/084989 (Patent Document 2) describe the copper alloy containing zirconium or others.

SUMMARY OF THE INVENTION

For an electrical wire or a cable for use in a movable portion, a conductor having a bendability representing difficulty in breaking against repeat bending while having a high electrical conductivity is necessary. However, for a copper alloy wire made of copper alloy containing zirconium, it is difficult to improve the bendability while maintaining the high electrical conductivity, and therefore, improvement on this point is desirable. That is, an attempt to improve the copper alloy wire made of copper alloy containing zirconium so as to be difficult to be broken against the repeat bending has decreased the electrical conductivity.

The present invention has been made in consideration of the problems as described above, and an object of the present invention is to improve the bendability of the copper alloy wire without the decrease in the electrical conductivity of the copper alloy wire made of copper alloy containing zirconium.

The summary of the typical aspects of the inventions disclosed in the present application will be briefly described as follows.

[1] A method of manufacturing a copper alloy wire includes: (a) a step of performing a solid-solution treatment to a copper material having a state in which zirconium is solid-solved in copper to from the copper material having a supersaturated solid-solution state; (b) after the step (a), a step of elongating the copper material having the supersaturated solid-solution state to form a first wire material; and (c) after the step (b), a step of performing a thermal treatment to the first wire material to form a first copper alloy wire. The method of manufacturing the copper alloy wire further includes: (d) after the step (c), a step of elongating the first copper alloy wire to form a second wire material; and (e) after the step (d), a step of performing a thermal treatment to the second wire material to form a second copper alloy wire having a copper crystal grain diameter that is equal to or smaller than 1 μm. In the step (c), a precipitate containing zirconium is deposited in the first copper alloy wire. In the step (d), the precipitate is dispersed in the second wire material. In the step (e), a thermal treatment is performed to the second wire material at 350 to 400° C. to deposit a precipitate containing zirconium in the second copper alloy wire.

[2] In the method of manufacturing the copper alloy wire described above in the item [1], in the step (c), a thermal treatment is performed to the first wire material at 350 to 400° C.

[3] In the method of manufacturing the copper alloy wire described above in the item [1] or [2], a content rate of the zirconium in the copper material is equal to or larger than 200 ppm by weight and equal to or smaller than 2000 ppm by weight.

[4] In the method of manufacturing the copper alloy wire described above in any one of the items [1] to [3], an electrical conductivity of the second copper alloy wire is equal to or higher than 87% IACS.

[5] In the method of manufacturing the copper alloy wire described above in any one of the items [1] to [4], a tensile strength of the second copper alloy wire is equal to or larger than 545 MPa.

[6] In a copper alloy wire, a precipitate containing zirconium is dispersed, and the copper alloy wire has a copper crystal grain diameter that is equal to or smaller than 1 μm, an electrical conductivity that is equal to or higher than 87% IACS, and a tensile strength that is equal to or larger than 545 MPa.

[7] A cable having a conductor made of the copper alloy wire described in the item [6].

According to the present invention, the bendability of the copper alloy wire can be improved without the decrease in the electrical conductivity of the copper alloy wire made of copper alloy containing zirconium.

BRIEF DESCRIPTIONS OF THE DRAWINGS

Figure 1:
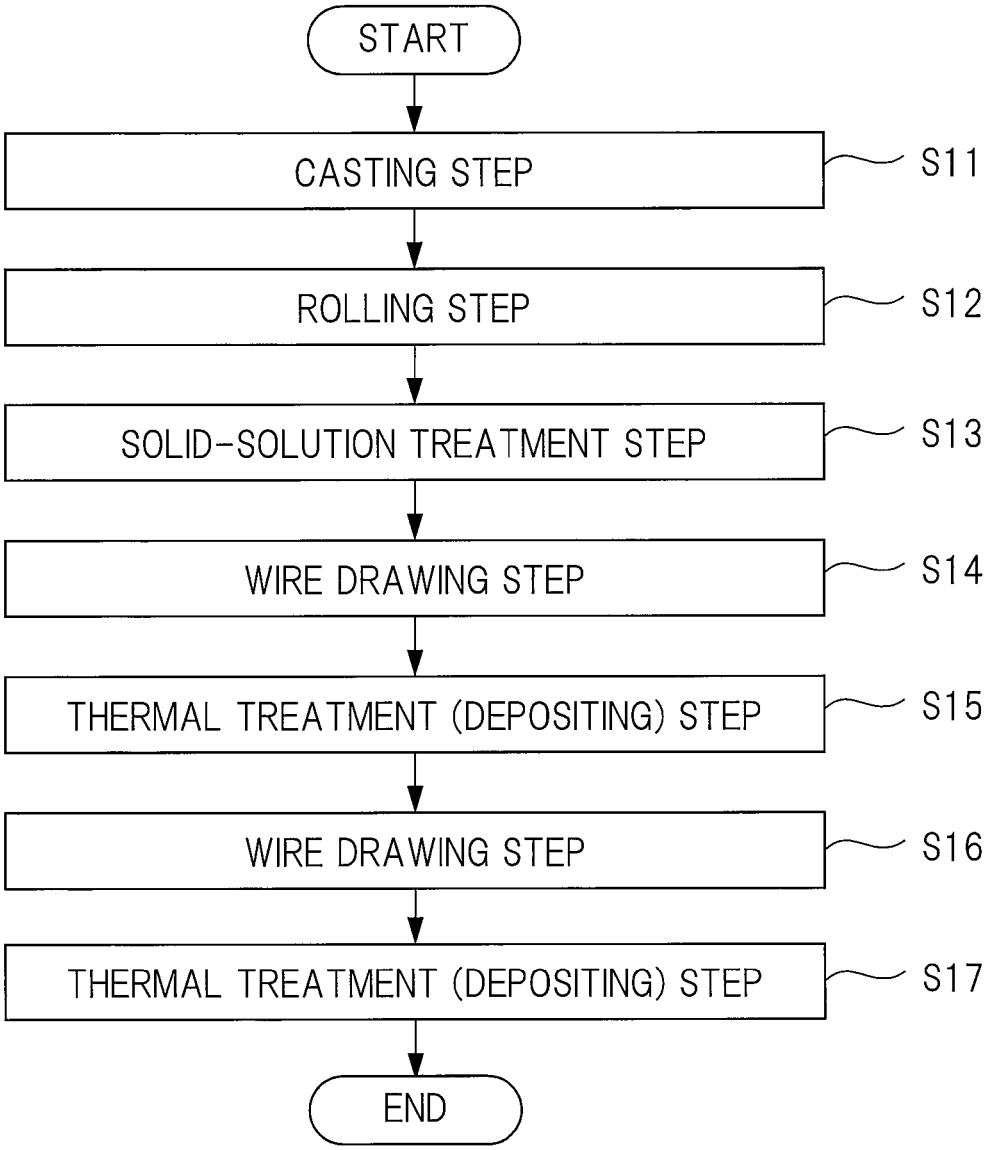
FIG. 1 is a process flowchart showing steps of manufacturing a copper alloy wire according to one embodiment.

DESCRIPTIONS OF THE PREFERRED EMBODIMENTS (Studied Contents)

<Previous Study>

First, before explanation of an embodiment, contents that have been studied by the present inventors will be explained. As described above, for a conductor configuring an electrical wire or a cable, a copper alloy wire made of copper alloy is used. For the electrical wire or cable, high mechanical strength is necessary. Therefore, it is desirable to improve mechanical strength of the copper alloy wire. As a method for improving the mechanical strength of the copper alloy wire, a solid-solution strengthening method is cited. This solid-solution strengthening method is a method of improving the mechanical strength of the copper alloy wire by utilizing a technique in which a solute atom (impurity atom) that is solid-solved inside or at a lattice position of a crystal architecture of a solvent atom (copper atom) prevents dislocation motion. However, in the copper alloy wire having the mechanical strength that has been improved by the solid-solution strengthening method, the solute atom (impurity atom) enters the solvent atom (copper atom) at an atomic level, and therefore, it is difficult to secure an original electrical conductivity of the copper, and the electrical conductivity significantly decreases. That is, in the solid-solution strengthening method, it is difficult to improve the mechanical strength of the copper alloy wire while securing the electrical conductivity of the copper alloy wire.

Therefore, study on improvement of the mechanical strength of the copper alloy wire while securing the electrical conductivity of the copper alloy wire by a deposition strengthening method will be described below.

First, outline of the deposition strengthening method will be explained. In order to apply the deposition strengthening method, it is necessary to perform (a) a solid-solution treatment step and (b) a thermal treatment (depositing) method.

The solid-solution treatment is a thermal treatment technique that maintains a metallographic structure, that is expressed at a high temperature, even at a room temperature by rapidly cooling an alloy from the high temperature to the room temperature. Particularly in the deposition strengthening method, it is important to rapidly cool the alloy so as to maintain a solid-solution state and generate a supersaturated solid-solution state. Therefore, the solid-solution treatment is also called an enforced solid-solution treatment.

Next, the thermal treatment step is performed to the supersaturated solid solution, so that an intermetallic compound is gradually deposited in a main body. An amount of the precipitates increases with time, and a property of the alloy changes. Therefore, such a thermal treatment is also called an aging treatment. As described above, the precipitates deposited in the main body function as obstacles against the dislocation motion, and therefore, the mechanical strength of the alloy is strengthened.

In the application of the deposition strengthening method as described above to the copper alloy wire, how to combine (a) the solid-solution treatment step and (b) the thermal treatment step has been studied.

The steps of manufacturing the copper alloy wire includes (1) a casting step, (2) a rolling step, and (3) a wire drawing step. Although described in detail later, a casting material of the copper alloy is formed in (1) the casting step, and a rolling material is formed by rolling the casting material in a hot rolling technique or others in (2) the rolling step. And, a wire drawing material is formed by drawing a wire of the rolling material in, for example, a cold wire drawing technique in (3) the wiredrawing step.

First, in order to apply the deposition strengthening method to the copper alloy wire, in the method of manufacturing the copper alloy wire, it has been studied to perform (a) the solid-solution treatment step and (b) the thermal treatment step after (3) the wiredrawing step. However, it has been found that the mechanical strength of the copper alloy wire that has been obtained by this manufacturing method is not high. The reason has been studied as follows.

First, as a result of the elongation of the copper alloy by (3) the wire drawing step, stress strain occurs in the crystal of the main body. Then, by heating the copper alloy in (b) the thermal treatment step, residual stress in the copper alloy wire is released by (3) the wire drawing step. In the manner, recrystallization of the copper in the main body is accelerated, and a crystal grain diameter of the main body is made larger than that before the thermal treatment step. In this case, it is experimentally known that Hall-Petch formula as described below is established as a relation between the crystal grain diameter and the mechanical strength.

$$\sigma_y=\sigma_0+k/\sqrt{d}$$

A term "$\sigma_y$" is an yield mechanical strength (yield stress) of a material, a term "$\sigma_0$" is a friction stress, a term "k" is a constant representing a resistance against crystal grain boundary sliding, and a term "d" is a crystal grain diameter.

From the Hall-Petch formula, it is found that the yield stress is larger as the crystal grain diameter is smaller. That is, it is though that the yield stress becomes small as a result of the increased crystal grain diameter of the copper since (b) the thermal treatment step is performed after (3) the wire drawing step. Therefore, by (a) the solid-solution treatment step and (b) the thermal treatment step after (3) the wire drawing step, the crystal grain diameter of the copper is increased because of the recrystallization of the copper, and therefore, the mechanical strength of the copper alloy wire cannot be strengthened.

Next, in order to apply the deposition strengthening method to the copper alloy wire, in the method of manufacturing the copper alloy wire, it has been studied to perform (a) the solid-solution treatment step and (b) the thermal treatment step after (2) the rolling step, and then, perform (3) the wire drawing step. According to the studies of the present inventors, it has been found that the stress strain occurs in the crystal of the main body as a result of the elongation of the copper alloy by (3) the wire drawing step, and thus, the crystal grain diameter of the main body is smaller than that before the wire drawing step. From the Hall-Petch formula, it is found that the yield stress is larger as the crystal is a polycrystalline body made of the finer crystal grain. This technique is equivalent to the strengthening method based on the crystal grain miniaturization. That is, the strengthening method based on the crystal grain miniaturization is a method of improving the mechanical strength of the alloy by reducing the crystal grain configuring the alloy on the basis of the fact that the yield stress is larger as the crystal is the polycrystalline body made of the finer crystal grain.

In the method of manufacturing the copper alloy wire, in the case of performing (2) the rolling step, then, performing (a) the solid-solution treatment step and (b) the thermal treatment step, and then, performing (3) the wire drawing step, it has been found that the electrical conductivity of the copper alloy wire significantly decreases. It is thought that this is because, when (3) the wire drawing step is performed in the state in which the precipitates are deposited in the main body by performing (a) the solid-solution treatment step and (b) the thermal treatment step as described above, the crystal grain diameter of the main body becomes too small, which results in the significant decrease in the electrical conductivity. Therefore, the electrical conductivity of the copper alloy wire cannot be increased in the case of performing (2) the rolling step, then, performing (a) the solid-solution treatment step and (b) the thermal treatment step, and then, performing (3) the wire drawing step.

By devisal of the method of manufacturing the copper alloy wire as described above, it is desirable to apply the deposition strengthening method and the strengthening method based on the crystal grain miniaturization to the copper alloy wire to suppress the decrease in the electrical conductivity of the copper alloy wire and improve the mechanical strength of the copper alloy wire.

Embodiment

<Method of Manufacturing Copper Alloy Wire of Present Embodiment>

One embodiment of the present invention will be explained below with reference to the drawings. Note that the same or similar components are denoted by the same or similar reference symbols or numerals throughout each drawing for describing the embodiment, and the repetitive description thereof will be omitted in principle.

FIG. 1 is a process flowchart showing the steps of manufacturing the copper alloy wire according to the present embodiment. As shown in FIG. 1, the steps of manufacturing the copper alloy wire according to the present embodiment include a casting step (S11), a rolling step (S12), a solid-solution treatment step (S13), a wire drawing step (S14), a thermal treatment (depositing) step (S15), a wire drawing step (S16), and a thermal treatment (depositing) step (S17). A specific procedure of each step will be explained below.

First, the casting step (S11) is performed. For example, pure copper (Cu) such as oxygen-free copper is heated in a crucible at about 1150° C. In the manner, the pure copper is molten to form a molten copper. Subsequently, copper-zirconium (Zr) mother alloy (for example, copper:zirconium=50 weight %:50 weight %) is added to the molten copper in the crucible. In the manner, molten copper containing zirconium is formed. At this time, it is preferable to adjust an additional amount of the copper-zirconium mother alloy so that a content rate of the zirconium in the molten copper is equal to or larger than 200 ppm by weight and equal to or smaller than 2000 ppm by weight (equal to or larger than 0.02 weight % and equal to or smaller than 0.20 weight %). Particularly, in a copper alloy wire having a diameter that is equal to or larger than 0.05 mm and equal to or smaller than 0.20 mm, when the content rate of the zirconium in the molten copper is equal to or larger than 1000 ppm by weight (0.10 weight %) and equal to or smaller than 2000 ppm by weight, this content rate is more preferable since the electrical conductivity is easy to be equal to or larger than 87% IACS while the precipitates made of the copper-zirconium compound is evenly dispersed in the copper. In this case, a reason why the zirconium is selected as the additive to the copper is that the decrease in the electrical conductivity of the copper is hardly observed even if the zirconium is added to the copper. For example, titanium (Ti) or chromium (Cr) is cited as a metal already contained in the copper or a metal to be contained in the copper other than the zirconium serving as a third component. This third component is not particularly limited as long as not decreasing the electrical conductivity of the copper even when being added to the copper.

Subsequently, the molten copper containing zirconium is run from the crucible into a die. Then, the die is cooled by water, so that, for example, a columnar casting material (ingot) having a diameter of 30 mm is formed. The casting step (S11) has been described up to here.

Note that a method of forming the molten copper containing the zirconium is not limited to the above-described method, and may be a method of forming the molten copper containing the zirconium by heating the copper and the zirconium together or a method of forming the molten copper containing the zirconium by adding only the zirconium to the molten copper. However, in a viewpoint of achievement of stability of an yield of the alloy, the method of adding the copper-zirconium mother alloy to the molten copper is preferable as the method of forming the molten copper containing the zirconium.

Next, the rolling step (S12) is performed. The hot rolling at, for example, about 800° C. is performed to the casting material formed in the casting step (S11), so that a columnar rolling material having a diameter of 12 mm is formed. After the hot rolling, the copper material is obtained by gradually cooling the rolling material by air cooling. The rolling step (S12) has been described up to here.

Next, the solid-solution treatment step (S13) is performed. The copper material formed in the rolling step (S12) is heated at about 850° C. for 1.5 hours, and then, is cooled by water cooling. As a rapid cooling condition, the water cooling may be performed so that the temperature of the copper material that is 800 to 900° C. goes down to about 15 to 20° C. for 5 to 10 seconds. In the manner, the copper material becomes in the supersaturated solid solution state. If it takes time for the solid-solution treatment, note that it is better at the time of the solid-solution treatment to the copper material to perform the solid-solution treatment in a state in which the gradually-cooled copper material is wound. The solid-solution treatment step (S13) has been described up to here. In the solid-solution treatment step (S13), note that the above-described solid-solution treatment using a different method from the water cooling may be performed.

A specific condition of the solid-solution treatment step (S13) will be explained here. In the copper material made of the alloy of the copper and the zirconium, when the content rate of the zirconium in the alloy is equal to or smaller than 2000 ppm by weight, a temperature of about 800 to 1100° C. causes a solid-solution state in which the zirconium is solid-solved in the copper. A temperature (such as 1200° C.) higher than the temperature causes a state in which the copper and the zirconium are molten. A temperature (such as 700° C.) lower than the temperature causes a state in which the zirconium is solid-solved in the copper. In order to obtain such a state, when the copper material containing the zirconium is heated at, for example, about 850° C., the solid-solution state in which the zirconium is solid-solved in the copper is caused. Then, the rapid cooling (quenching) treatment is performed to the copper material having the solid-solution state, so that the copper material containing the zirconium becomes in the supersaturated solid-solution state.

From the studies made by the present inventors, it has been found that, when the heating temperature of the copper material in the solid-solution treatment step (S13) is equal to or higher than 900° C., there is a risk of occurrence of a coarse crystal of the main body (copper). Therefore, the heating temperature of the copper material in the solid-solution treatment step (S13) is preferably 800 to 900° C. And, since a dispersion speed of the zirconium in the copper is large in the high temperature of about 800° C., it is easier to deposit the fine precipitate made of the copper-zirconium compound in the water cooling than a furnace cooling as the cooling of the copper material. Therefore, it is preferable to perform the water cooling as the cooling of the copper material.

Next, the wire drawing step (S14) is performed. The copper material (having the diameter of 12 mm) having the supersaturated solid-solution state formed by the solid-solution treatment step (S13) is drawn by, for example, using a dice to form a wire drawing material (first wire material) (having a diameter of 0.26 mm). As described above, by the wire drawing step (S14), the copper material is elongated so that the crystal grain diameter of the main body is smaller than that before the wire drawing step. The wire drawing step (S14) has been described up to here.

Next, the thermal treatment (depositing) step (S15) is performed. The wire drawing material formed in the wire drawing step (S14) is heated at 350 to 400° C. for one hour. Such a thermal treatment is performed to the wire drawing material having the supersaturated solid-solution state, so that a precipitate (first precipitate, the intermetallic compound of copper and zirconium) is gradually deposited in the main body (copper). An amount of the precipitate increases with time, and characteristics of the copper containing zirconium change. Therefore, such a thermal treatment is also called an aging treatment. In this step, note that the dispersion of the zirconium in the copper is slower than that in the above-described high temperature since the heating of the wire drawing material starts from a room temperature, and therefore, the copper-zirconium compound is finely deposited in the main body. The thermal treatment step (S15) has been described up to here, and the wire drawing material after the thermal treatment step (S15) becomes the copper alloy wire (first copper alloy wire).

Next, in the wire drawing step (S16), a wire drawing material (second wire material) (having a diameter of 0.08 mm) is formed by drawing the wire drawing material (having the diameter of 0.26 mm) in which the precipitate (the copper-zirconium compound) is deposited in the thermal treatment (depositing) step (S15), by using, for example, a dice. The wire drawing step (S16) has been described up to here.

Next, in the thermal treatment (depositing) step (S17), the wire drawing material formed in the wire drawing step (S16) is heated at 350 to 400° C. for one hour as similar to the thermal treatment (depositing) step (S15). In the manner, a precipitate (second precipitate, the intermetallic compound of copper and zirconium) is gradually deposited in the main body (copper). The thermal treatment (depositing) step (S17) has been described up to here, and the wire drawing material after the thermal treatment step (S17) becomes the copper alloy wire (second copper alloy wire). In the above-described wire drawing step, the diameter of the wire drawing material is appropriately changed, so that the diameter of the obtained copper alloy wire can be in a range that is equal to or larger than 0.05 mm and equal to or smaller than 0.20 mm.

As described above, by the casting step (S11) to the thermal treatment step (S17), the copper alloy wire of the present embodiment can be manufactured.

Note that the precipitate deposited in the thermal treatment (depositing) step (S15) and the precipitate deposited in the thermal treatment (depositing) step (S17) may be the same as or different from each other.

<Principal Feature and Effect of Present Embodiment>

As one of the principal features of the present embodiment, the method of manufacturing the copper alloy wire includes the wire drawing step (S14) between the solid-solution treatment step (S13) and the thermal treatment (depositing) step (S15). Further, the method includes the wire drawing step (S16) and the thermal treatment (depositing) step (S17) after the thermal treatment (depositing) step (S15).

As described above, in the method of manufacturing the copper alloy wire, when the solid-solution treatment step and the thermal treatment step are performed after the wire drawing step, the crystal grain diameter of the main body (copper) becomes too large, and therefore, the mechanical strength of the copper alloy wire cannot be increased.

On the other hand, in the method of manufacturing the copper alloy wire, when the solid-solution treatment step and the thermal treatment step are performed after the rolling step, and then, the wire drawing step is performed, the crystal grain diameter of the main body (copper) becomes too small, and therefore, the electrical conductivity of the copper alloy wire cannot be increased.

Accordingly, in the present embodiment, when "the solid-solution treatment step (S13)→the wire drawing step (S14) →the thermal treatment step (S15)" are performed in this order, while the crystal grain diameter of the main body (copper) becomes small in the wire drawing step (S14), the main body (copper) is recrystallized by the thermal treatment step (S15) so that the crystal grain diameter becomes large. At the same time, since the precipitate made of the copper-zirconium compound is deposited by the thermal treatment step (S15), the growth of the crystal is suppressed by this precipitate, and therefore, the crystal grain diameter of the main body (copper) does not become too large. That is, the crystal grain diameter of the main body (copper) after the thermal treatment step (S15) is smaller than that before the wire drawing step (S14). In this manner, in the present embodiment, since the precipitate (the copper-zirconium compound) deposited in the main body (copper) suppresses the crystal growth, the crystal grain diameter of the main body in the copper alloy wire is optimized.

As described above, in the present embodiment, since the precipitate (the copper-zirconium compound) deposited in the main body (copper) functions as an obstacle against the dislocation motion, the mechanical strength of the copper alloy wire is improved more than that in the case without the precipitate.

In the present embodiment, since the method includes the second wire drawing step (S16) and the second thermal treatment step (S17) after the thermal treatment step (S15), the second wire drawing step (S16) can be performed in the state in which the precipitate (the copper-zirconium compound) is deposited in the main body (copper). In this manner, by the wire drawing step (S16), the precipitate is dispersed so as to spread in the entire main body (copper). At this time, it is preferable to avoid the local agglomeration of the precipitate. By the second thermal treatment step (S17), the precipitate is further deposited in the main body (copper). As a result, in the present embodiment, the mechanical strength of the copper alloy wire is improved since the amount of the precipitate in the main body (copper) is larger than that in the case with only the first thermal treatment step and since the precipitate deposited by the thermal treatment step (S17) does not agglomerate but widely disperses in the main body while the precipitate disperses so as to spread in the entire main body (copper) by the wire drawing step (S16). In this manner, in the present embodiment, a copper alloy wire having a tensile strength that is equal to or larger than 545 MPa is obtained.

In the present embodiment, the method includes the second wire drawing step (S16) between the first thermal treatment step (S15) and the second thermal treatment step (S17). If the first and second thermal treatment steps are continuously performed, the crystal grain diameter of the main body (copper) becomes too large, and therefore, the mechanical strength of the copper alloy wire decreases. Accordingly, the second wire drawing step (S16) is performed after the first thermal treatment step (S15), so that the crystal grain diameter of the main body (copper) is tentatively made small. After that, the second thermal treatment step (S17) is performed, so that the crystal grain diameter of the main body (copper) becomes large again to be optimized. As a result, the mechanical strength of the copper alloy wire can be further increased while the electrical conductivity of the copper alloy wire is not smaller than that in the case with only the first thermal treatment step.

As described above, according to the method of manufacturing the copper alloy wire of the present embodiment, the deposition strengthening method and the strengthening method based on the crystal grain miniaturization can be combined with each other, and therefore, the mechanical strength of the copper alloy wire can be improved while the electrical conductivity of the copper alloy wire does not decrease.

As another embodiment, note that a plurality of wire drawing steps and a plurality of thermal treatment (depositing) steps can be further repeated after the thermal treatment (depositing) step (S17) of the present embodiment. In this case, the precipitate in the main body can be deposited more than that in the present embodiment, and the precipitate in the main body can be further widely dispersed than the present embodiment. In further consideration of a manufacturing cost, it appears that the present embodiment is most preferable.

In a viewpoint of achievement of the copper alloy wire having the above-described tensile strength, in order to optimize the crystal grain diameter of the main body (copper) (so as to be equal to or smaller than 1 μm), while it is necessary to set a thermal treatment (heating) temperature in the thermal treatment (depositing) step (S17) to be 350 to 400° C., it is preferable to set a thermal treatment (heating) temperature in the thermal treatment (depositing) step (S15) to be the same as the temperature in the thermal treatment (depositing) step (S17).

In the present embodiment, note that it is preferable to set a content of the zirconium to be equal to or larger than 200 ppm by weight and equal to or smaller than 2000 ppm by weight. The present inventors have verified that the content of the zirconium in the above-described range causes high electrical conductivity (that is equal to or higher than 87% IACS) and excellent endurance against repeat bending (the conductor is not broken even by repeat bending of ten thousand times or more). Particularly in the copper alloy wire according to the present embodiment, when the content of the zirconium is set to be equal to or larger than 1000 ppm by weight and equal to or smaller than 2000 ppm by weight, the zirconium solid-solved in the copper of the copper alloy wire according to the present embodiment is deposited as the precipitate (the copper-zirconium compound), so that a purity of the copper is easily close to a state of the pure copper, and the deposited fine precipitate (the copper-zirconium compound) easily evenly disperses in the copper. Therefore, the copper alloy wire according to the present embodiment having the diameter that is equal to or larger than 0.05 mm and equal to or smaller than 0.20 mm can have the characteristics such as the electrical conductivity that is equal to or higher than 87% IACS and the tensile strength that is equal to or larger than 545 MPa, and can be excellent in the endurance against the repeat bending.

In the present embodiment, the removal of the solid-solution treatment step (S13) is also thought for cost reduction. However, the casting material formed by the casting step (S11) has a state in which the coarse copper-zirconium compounds are dotted. Therefore, even if the solid-solution treatment step (S13) is not performed but the thermal treatment step (S15) is performed, there is a possibility not only that the precipitate does not evenly disperse but also that the precipitate does not originally deposit in the main body. Therefore, the method of manufacturing the copper alloy wire preferably includes the solid-solution treatment step (S13).

<Cable Using Copper Alloy Wire>

Figure 2:
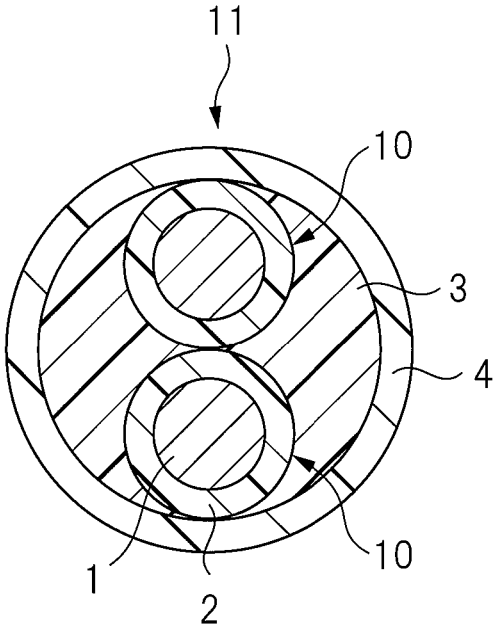
FIG. 2 is a lateral cross-sectional view showing a structure of a cable according to one embodiment.

FIG. 2 is a schematic view showing a cable using the copper alloy wire according to one embodiment of the present invention.

As shown in FIG. 2, a cable 11 according to the present embodiment includes: a two-core stranded wire formed by intertwining two electrical wires 10 made of a conductor 1 and an insulating layer 2 covering the conductor 1; a filler 3 formed around the two-core stranded wire; and a sheath 4 formed around the filler 3 and the electrical wire 10.

As the conductor 1 configuring the cable 11 of the present embodiment, the copper alloy wire manufactured by the method of manufacturing the copper alloy wire of the above-described embodiment is used. As described later, the copper alloy wire manufactured by the method of manufacturing the copper alloy wire of the above-described embodiment is a copper alloy wire in which the precipitate containing zirconium disperses, and has the crystal grain diameter that is equal to or smaller than 1 μm and the electrical conductivity that is equal to or higher than 87% IACS. As the conductor 1, note that a stranded conductor formed by intertwining the copper alloy wires each manufactured by the method of manufacturing the copper alloy wire of the above-described embodiment can be also used.

The cable 11 of the present embodiment is manufactured as, for example, follows. First, the copper alloy wire manufactured by the manufacturing method is prepared as the conductor 1. By using an extruder, the insulating layer 2 having a predetermined thickness made of a fluorine resin, a polyvinyl chloride resin, a silicon rubber or others is formed so as to cover the conductor 1. In this manner, the electrical wire 10 can be manufactured. After two electrical wires 10 described above are manufactured, the two electrical wires 10 are intertwined together with the filler 3 such as a staple fiber, and then, the sheath 4 having a predetermined thickness made of a polyvinyl chloride resin, a silicon rubber or others is formed so as to cover the filler 3 and the insulating layer 10. In this manner, the cable 11 of the present embodiment can be manufactured.

The case of the cable 11 of the present embodiment having the two-core stranded wire made of two stranded electrical wires 10 as the core wire has been exemplified and explained. The core wire may be single (one)-core wire or a multicore stranded wire that is not a two-core wire. Alternatively, the cable may be a cable with a shield having a shield layer between the electrical wire 10 and the sheath 4, the shield layer being formed by braiding a plurality of metal bare wires.

<Characteristics of Copper Alloy Wire>

The characteristics of the copper alloy wire manufactured by the method of manufacturing the copper alloy wire of the above-described embodiment will be explained below. In the following first and second practical examples and first to fourth comparative examples, note that the copper material was obtained in the manufacturing steps shown in FIG. 1 by adding the copper-zirconium mother alloy into the molten copper so that the content amount of the zirconium in the molten copper is 1400 ppm by weight to form the casting material, and performing the hot rolling to the casting material at a hot rolling temperature of about 800° C. to form a rolling material (having a diameter of about 12 mm), and then, gradually cooling the rolling material. And, the first copper alloy wire was formed by performing the solid-solution treatment to this copper material at a temperature of about 850° C. to form the copper material having the supersaturated solid-solution state, and performing the wire drawing process to this copper material having the supersaturated solid-solution state so as to cause a diameter of 0.26 mm, and then, performing a thermal treatment at a thermal treatment temperature of 350° C. And, the second copper alloy wire was formed by performing the wire drawing process to this first copper alloy wire so as to cause a diameter of 0.08 mm, and then, performing a thermal treatment at a thermal treatment temperature shown in a table 1. This second copper alloy wire is a copper alloy wire containing about 1300 ppm by weight of zirconium and having a remainder made of copper and inevitable impurity.

Figure 3:
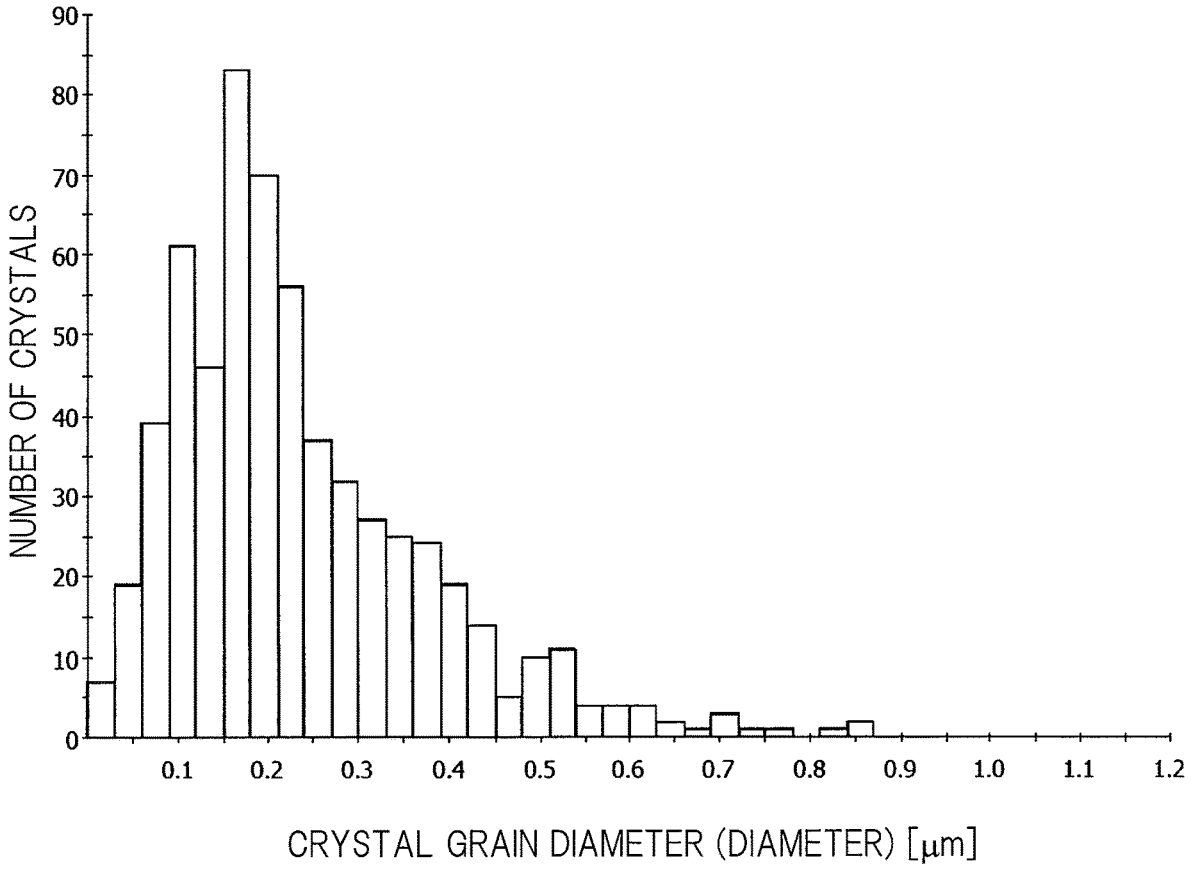
FIG. 3 is a graph showing distribution of crystal grain diameters of the copper alloy wire according to the one embodiment.
Figure 4:
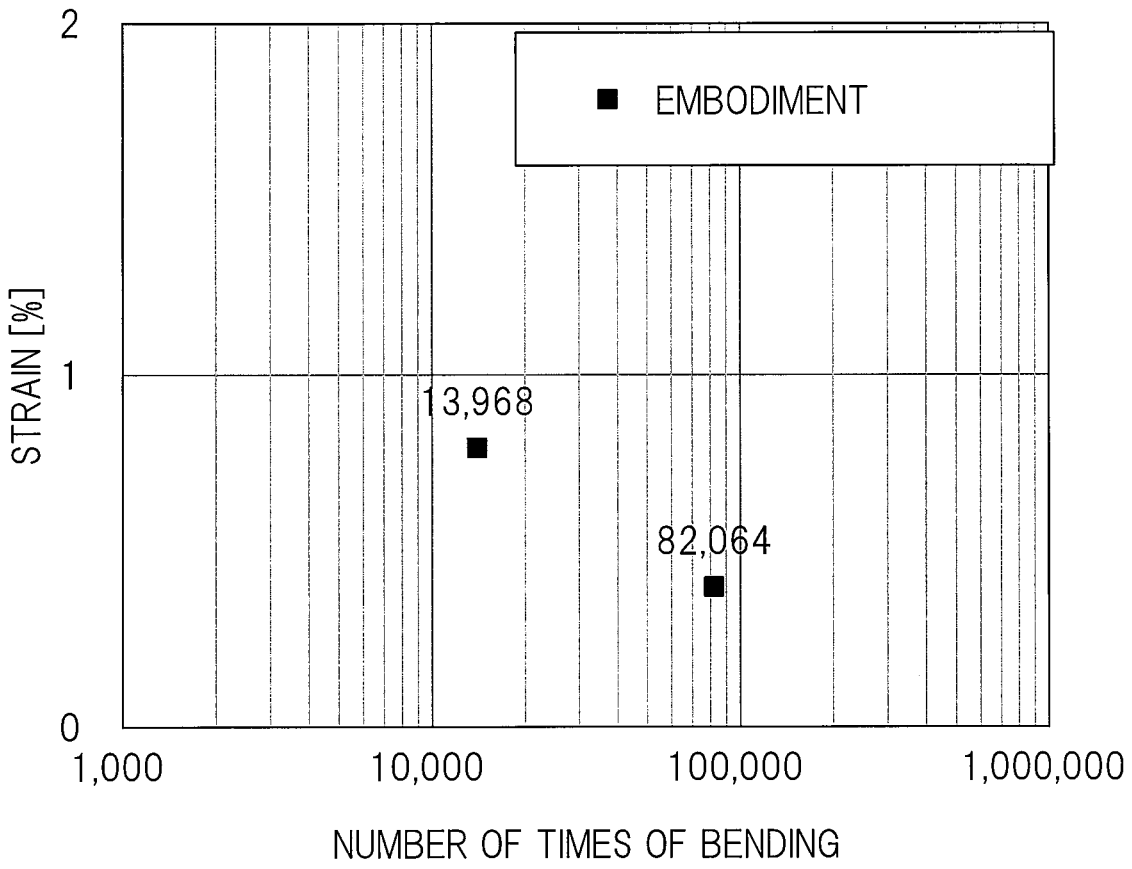
FIG. 4 is a graph showing results of a bending test on the copper alloy wire according to the one embodiment.

The table 1 is a table showing relations among the electrical conductivity of, the tensile strength of, and a 0.2% proof stress of the copper alloy wire manufactured by the method of manufacturing the copper alloy wire of the above-described embodiment, and the thermal treatment temperature in the manufacturing steps. FIG. 3 is a graph showing distribution of crystal grain diameters of the copper alloy wire according to the above-described embodiment. FIG. 4 is a graph showing results of a bending test on the copper alloy wire according to the above-described embodiment.

Particularly, since permanent strain at the time of the yielding of the copper is 0.2%, a stress at which permanent strain at the time of the unloading is 0.2% is called 0.2% proof stress, and is used in place of the yield stress. That is, when the 0.2% proof stress of the copper alloy wire is large, the copper alloy wire is difficult to be cut, and besides, the copper alloy wire is difficult to be bent.

Note that the 0.2% proof stress of the copper alloy wire represents the difficulty in cutting at a region having a small strain in the copper alloy wire, and the tensile strength of the copper alloy wire represents the difficulty in cutting at a region having a large strain in the copper alloy wire In the above-described premise, the columns of the second to fourth comparative examples of the table 1 show the measured results of physical values of copper alloy wire samples (each having a diameter of 0.08 mm) manufactured when the thermal treatment (heating) temperatures in the thermal treatment (depositing) step (S15) of the above-described embodiment are set to 350, 400 and 450° C., respectively, while the later steps (S16 and S17) are not performed. The columns of the first and second practical examples and the first comparative example of the table 1 show the measured results of physical values of the copper alloy wire samples (each having a diameter of 0.08 mm) manufactured when the thermal treatment (heating) temperatures in the thermal treatment (depositing) step (S15) of the above-described embodiment are set to 350° C. while the thermal treatment (heating) temperatures in the thermal treatment (depositing) step (S17) are set to 350, 400 and 450° C., respectively.

TABLE 1

| | FIRST PRACTICAL EXAMPLE | SECOND PRACTICAL EXAMPLE | FIRST COMPARATIVE EXAMPLE | SECOND COMPARATIVE EXAMPLE | THIRD COMPARATIVE EXAMPLE | FOURTH COMPARATIVE EXAMPLE |
|---|---|---|---|---|---|---|
| THERMAL TREATMENT TEMPERATURE (° C.) | 350 * | 400 * | 450 * | 350 | 400 | 450 |
| ELECTRICAL CONDUCTIVITY (% IACS) | 87 | 90 | 92 | 86 | 90 | 91 |
| TENSILE STRENGTH (MPa) | 594 | 545 | 493 | 566 | 526 | 475 |
| 0.2% PROOF STRESS (MPa) | 552 | 497 | 441 | 531 | 471 | 423 |

* Second thermal treatment temperature

The temperature first thermal treatment is 350° C.

(Measurement of Electrical Conductivity, Tensile Strength and 0.2% Proof Stress)

The measurement of the electrical conductivity was made by measuring a resistance value of the obtained copper alloy wire by a four terminal method, and converting the obtained resistance value in % IACS equivalent.

The measurements of the tensile strength and the 0.2% proof stress were made by performing a tensile test in conformity with JIS Z2214. In the tensile test, note that a tensile speed was set to 20 mm/min., and a gauge length (grip width) was set to 100 mm.

First, measured physical property values will be explained. The electrical conductivity of the copper alloy wire in the table 1 is represented with reference to % IACS. "% IACS" is an electrical conductivity obtained when $1.7241\times10^{-8}$ Ωm that is a resistivity of the International Annealed Copper Standard is set to be 100%.

The tensile strength of the copper alloy wire shown in the table 1 represents rigidity of the copper alloy wire, and the copper alloy wire has a larger value as being more rigid. When the tensile strength of the copper alloy wire is large, the copper alloy wire is difficult to be cut, and besides, the copper alloy wire is difficult to be bent.

The 0.2% proof stress of the copper alloy wire shown in the table 1 represents difficulty of plastic strain of the copper alloy wire. The proof stress is a stress that is equivalent to an yield stress representing boundary between elastic strain and plastic strain in a material not having a clear yield point.

First, regarding the number of execution times of the thermal treatment step, the first and second practical examples and the first comparative example in which the thermal treatment step was performed twice are compared with the second to fourth comparative examples in which the thermal treatment step was performed only once. As shown in the table 1, the first and second practical examples and the first comparative example are almost the same in the electrical conductivity of the copper alloy wire as, but more improved in the mechanical strength of the copper alloy wire those of the second to fourth comparative examples. As described above, in the first and second practical examples and the first comparative example that are obtained by the method of manufacturing the copper alloy wire of the above-described embodiment, it is thought that the amount of the precipitate in the main body is larger and the precipitate in the main body disperses to be wider than those of the second to fourth comparative examples in which the thermal treatment step was performed only once. Therefore, the first and second practical examples and the first comparative example that are obtained by the method of manufacturing the copper alloy wire of the above-described embodiment are more advantageous than the second to fourth comparative examples in which the thermal treatment step was performed only once in the viewpoint of the achievement of the further improvement of the mechanical strength of the copper alloy wire without the decrease in the electrical conductivity of the copper alloy wire.

Next, the first and second practical examples and the first comparative example are compared with one another in the thermal treatment (heating) temperature in the thermal treatment step. As shown in the table 1, in the above-described embodiment, as the thermal treatment (heating) temperature in the thermal treatment (depositing) step (S17) is higher, the electrical conductivity of the copper alloy wire is higher. It is thought that these results show synergetic effect between an effect of causing the larger crystal grain diameter of the main body than that before the thermal treatment since the residual stress in the wire drawing step is released by the thermal treatment and an effect of increase in the purity of the copper of the main body since the zirconium is taken out of the main body (copper) by the deposition of the precipitate (the copper-zirconium compound) by the thermal treatment. As described above, note that the electrical conductivity almost hardly decreases even when the zirconium is added to the copper. Therefore, even when the amount of the precipitate (the copper-zirconium compound) is large, influence on the electrical conductivity is small. As understood from these results, in the viewpoint of the achievement of the high electrical conductivity of the copper alloy wire, a higher temperature of the thermal treatment step is preferable. When the copper alloy wire is used as the electrical wire or the conductor 1 of the cable 11 shown in FIG. 3, the electrical conductivity is preferable to be equal to or higher than 87% IACS, and therefore, the thermal treatment temperature is preferable to be equal to or higher than 350° C.

Next, as shown in the table 1, in the above-described embodiment, as the thermal treatment (heating) temperature of thermal treatment (depositing) step (S17) is higher, the tensile strength of the copper alloy wire is smaller. As shown in the table 1, in the above-described embodiment, as the thermal treatment (heating) temperature of thermal treatment (depositing) step (S17) is higher, the 0.2% proof stress of the copper alloy wire is smaller. These results show that the tensile stress and the 0.2% proof stress of the copper alloy wire are affected by an effect of weakening based on the coarse crystal grain (that is opposite to the effect of the strengthening method based on the crystal grain miniaturization, a grain-boundary strengthening method) on the basis of the fact that the crystal grain diameter of the main body is larger than that before the thermal treatment more than the effect of the deposition strengthening method strengthening the copper alloy wire on the basis of the deposition of the precipitate (the copper-zirconium compound) serving as the obstacle against the dislocation motion. That is, in the viewpoint of the achievement of the large tensile stress and the large 0.2% proof stress of the copper alloy wire, a lower temperature of the thermal treatment step is preferable. When the copper alloy wire is used as the electrical wire or the conductor 1 of the cable 11 shown in FIG. 3, the tensile stress is preferable to be equal to or larger than 545 MPa, and therefore, the thermal treatment temperature is preferable to be equal to or lower than 400° C.

In this manner, in the above-described embodiment, the thermal treatment (heating) temperature of the thermal treatment (depositing) step (S17) is preferable to be equal to or higher than 350° C. and equal to or lower than 400° C. in a viewpoint of balance between the electrical conductivity and the mechanical strength.

Although not shown in the table 1, the first and second practical examples and the first comparative example have almost the same measured results of the physical values of the copper alloy wire samples (each having the diameter of 0.08 mm) as one another when the thermal treatment (heating) temperatures in the thermal treatment (depositing) step (S15) of the above-described embodiment were set to 350° C. while the thermal treatment (heating) temperatures in the thermal treatment (depositing) step (S17) were set to 350, 400 and 450° C., respectively. Therefore, the thermal treatment (heating) temperature of the thermal treatment (depositing) step (S15) that is the first thermal treatment step is preferable to be equal to or higher than 350° C. and equal to or lower than 400° C. However, the temperature is not limited to 350° C. shown in the table 1.

Subsequently, the measurement results of the crystal grain diameters of the copper alloy wire will be explained. FIG. 3 is a graph showing distribution of the crystal grain diameters of the copper alloy wire according to the above-described embodiment.

In the measurement of the crystal grain diameters, a crystal gain diameter on a lateral cross-sectional surface (cross-sectional surface that is orthogonal to a longitudinal direction) of the copper alloy wire was measured in terms of a diameter of an area equivalent circle as distribution of the crystal gain diameters shown in FIG. 3 by an EBSD (Electron Back Scatter Diffraction Patterns) method. Note that the EBSD method is a method of projecting a diffraction pattern of electrons reflected on a sample onto a detector surface of a SEM (Scanning Electron Microscope) and analyzing a crystal orientation by using the projected pattern. In the measurement of the crystal grain diameter, a measured region of the lateral cross-sectional surface was set to about 33.6 $\mu m^2$.

As the sample of the copper alloy wire, a sample manufactured when the thermal treatment (heating) temperature of the thermal treatment (depositing) step (S17) in the method of manufacturing the copper alloy wire according to the above-described embodiment is set to 350° C. was used.

As shown in FIG. 3, in the copper alloy wire according to the present embodiment, the maximum value of the crystal grain diameters of the main body (copper) was measured to be 1 μm, and an average grain diameter of the main body (copper) was measured to be 0.24 μm. Although not shown in the drawing, in all the copper alloy wires manufactured when the thermal treatment (heating) temperature is set to 350 to 400° C. in the above-described embodiment, the maximum value of the crystal grain diameters were equal to or smaller than 1 μm. And, there is a crystal having a crystal grain diameter that is several tens of nanometers in addition to the main body (copper). When this crystal was analyzed in an EDS (Energy Dispersive X-ray Spectroscopy), it was verified that the crystal is the copper-zirconium compound.

On the basis of the above-described results, the copper alloy wire manufactured by the method of manufacturing the copper alloy wire of the present embodiment can be specified as a copper alloy wire in which the precipitate containing zirconium disperses, and which has the crystal grain diameter that is equal to or smaller than 1 μm, the electrical conductivity that is equal to or higher than 87% IACS, and the tensile strength that is 545 MPa.

Subsequently, the bendability of the copper alloy wire of the present embodiment will be explained. FIG. 4 is a graph showing results of a bending test on the copper alloy wire according to the above-described embodiment.

The bending test was performed in the following procedure. The copper alloy wire sample was set between a pair of columnar bending jigs (each having a radius "R") by using a general bending tester. In a state (A) in which a load is applied to the sample itself, the bending jigs were moved to bend the sample along the bending jigs (state "B": the sample was bent by 90 degrees from an original position). Then, after the sample was returned to the original position (A), the sample was bent in a direction that is opposite to the previous direction (state "C"). When it is assumed that one cycle made of "(A)→(B)→(A)→(C)→(A)" is regarded as one time, the number of times taken until the sample is broken was measured. As conditions of the bending test, the load was set to 8.8 g, and two types of the bending jigs having "R=5" (strain 0.79%) and "R=10" (strain 0.40%) were prepared. As the sample of the copper alloy wire, a sample having a diameter of 0.08 mm and manufactured when the thermal treatment (heating) temperature of the thermal treatment (depositing) step (S17) in the method of manufacturing the copper alloy wire of the above-described embodiment was set to 350° C. was used (First Practical Example).

As shown in FIG. 4, the number of times of bending of the copper alloy wire of the present embodiment when the strain is 0.40% was 82064 times, and the number of times of bending of the same when the strain is 0.79% was 13968 times. In the copper alloy wire of the present embodiment, the tensile strength was 594 MPa, the 0.2% proof stress was 552 MPa (see the table 1). From these results, it is found that the copper alloy wire of the present embodiment has the excellent bending resistance life. Note that the strain as the condition of this bending test was set to be relatively small. In comparison between the present embodiment and the comparative examples, it is thought that influence of the 0.2% proof stress on the bendability of the region having the small strain is larger than influence of the tensile stress thereon.

In the cable 11 of the present embodiment shown in FIG. 3, the copper alloy wire of the present embodiment is applied to the conductor 1. As shown in the table 1, each of the copper alloy wires (the first and second practical examples) of the present embodiment has the electrical conductivity that is equal to or higher than 87% IACS and the tensile stress that is equal to or larger than 545 MPa. Particularly, as shown in FIG. 4, the copper alloy wire of the present embodiment is excellent in the resistance against the bending. Therefore, the cable 11 of the present embodiment can be widely applied as a cable particularly requiring the resistance against the bending, such as a robot cable (a connectable cable to a robot).

The present invention is not limited to the foregoing embodiments, and various modifications can be made within the scope of the present invention.

What is claimed is:

1. A method of manufacturing a copper alloy wire comprising the steps of:

(a) performing a solid-solution treatment to a copper material having a state in which zirconium is solid-solved in copper to form the copper material having a supersaturated solid solution state;

(b) after the step (a), elongating the copper material having the supersaturated solid solution state to form a first wire material;

(c) after the step (b), performing a thermal treatment to the first wire material to form a first copper alloy wire;

(d) after the step (c), elongating the first copper alloy wire to form a second wire material; and (e) after the step (d), performing a thermal treatment to the second wire material to form a second copper alloy wire having a copper crystal grain diameter that is equal to or smaller than 1 μm, wherein, in the step (a), water cooling is performed so that a temperature of the copper material that is 800 to 850° C. goes down to about 15 to 20° C. for 5 to 10 seconds, wherein, in the step (c), a precipitate containing the zirconium is deposited in the first copper alloy wire, wherein, in the step (d), the precipitate is dispersed in the second copper alloy wire, wherein, in the step (e), a thermal treatment is performed to the second wire material at 350 to 400° C. to deposit a precipitate containing the zirconium in the second copper alloy wire, wherein a content rate of the zirconium in the copper material is equal to or larger than 1000 ppm by weight and equal to or smaller than 2000 ppm by weight, wherein, when a diameter of the second copper alloy wire is 0.05 mm or more and 0.20 mm or less, an electrical conductivity of the second copper alloy wire is equal to or higher than 87% IACS, wherein, when the diameter of the second copper alloy wire is 0.05 mm or more and 0.20 mm or less, a tensile stress of the second copper alloy wire is equal to or larger than 545 MPa, wherein the copper material does not contain chromium, wherein the first wire material does not contain chromium, wherein the first copper alloy wire does not contain chromium, wherein the second wire material does not contain chromium, and wherein the second copper alloy wire does not contain chromium.

2. The method of manufacturing the copper alloy wire according to claim 1, wherein, in the step (c), the thermal treatment is performed to the first wire material at 350 to 400° C.

* * * * *